PM039 XR 4,365,700

United States Patent [19]
Arimoto et al.
[11] 4,365,700
[45] Dec. 28, 1982

[54] MONEY RECEIVING AND DISPENSING SYSTEM

[75] Inventors: Katsuhiko Arimoto, Omihachiman; Masahiro Fujimoto, Kusatsu, both of Japan

[73] Assignee: Omron Tateisi Electronics Co., Kyoto, Japan

[21] Appl. No.: 176,690

[22] Filed: Aug. 8, 1980

[30] Foreign Application Priority Data

Aug. 24, 1979 [JP] Japan ..... 54-108459

[51] Int. Cl.³ ..... G07D 11/06

[52] U.S. Cl. ..... 194/2; 194/DIG. 26; 133/3 R; 133/4 R

[58] Field of Search ..... 194/1 R, 2, DIG. 26; 133/1 R, 2, 3 R, 4 R, 8 R; 235/379-382

[56] References Cited

U.S. PATENT DOCUMENTS 3,072,237 1/1963 Simjian .
3,173,431 3/1965 Chichester et al. ..... 133/3 R
3,682,183 8/1972 Morrow et al. .
3,756,363 9/1973 Novak et al. .
3,791,392 2/1974 Hanson .
4,121,603 10/1978 Hayashi ..... 133/2
4,166,945 9/1979 Inoyama et al. ..... 235/381 X
4,249,552 2/1981 Margolin et al. ..... 133/1 R
4,253,016 2/1981 Hirose ..... 194/DIG. 26

FOREIGN PATENT DOCUMENTS 7428083 8/1974 France .

*Primary Examiner*—David A. Scherbel
*Attorney, Agent, or Firm*—Wegner & Bretschneider

[57] ABSTRACT

A money receiving and dispensing system is disclosed having a plurality of money cases for storing monies of several denominations, respectively, a stock money cartridge removably mounted in the system for collectively storing monies available in the system, a plurality of entering devices each for entering monies into the corresponding one of the money cases and stock money cartridge, a plurality of feeders for respectively feeding the monies stored in the money cases and stock money cartridge, a money receiver for receiving the money deposited into the system to store the received money in one of the money cases and stock money cartridge, and a money dispenser for dispensing the money fed by one of the feeding means.

6 Claims, 15 Drawing Figures

FIG.1
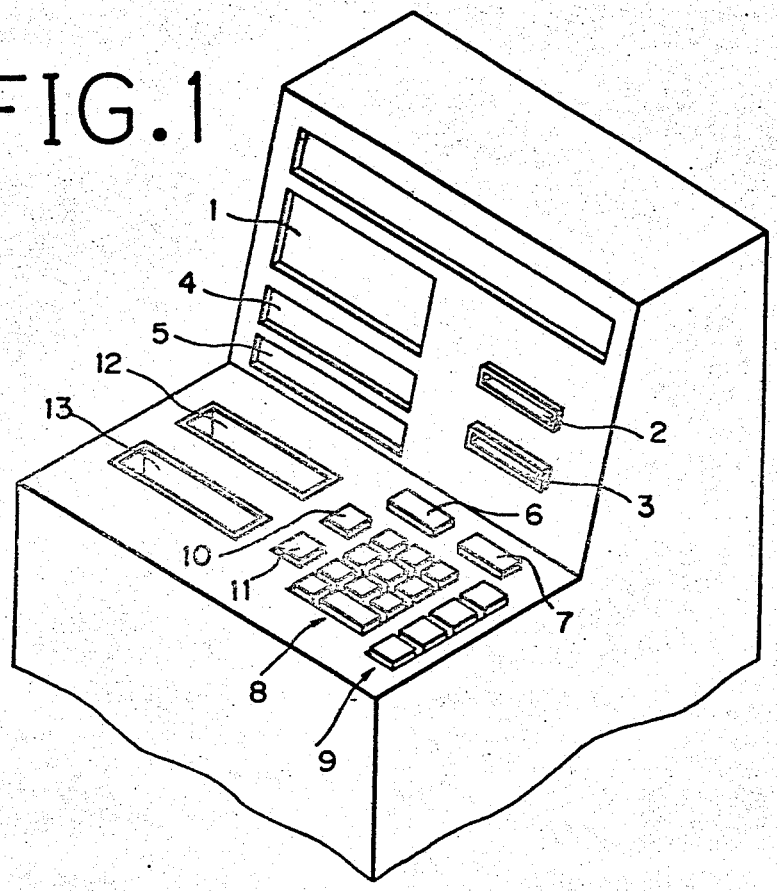
FIG.3A FIG.3B
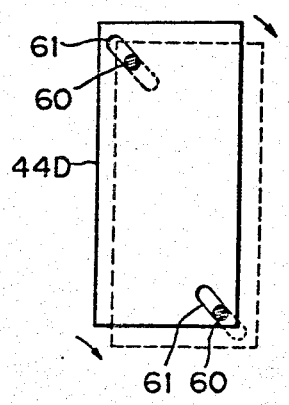
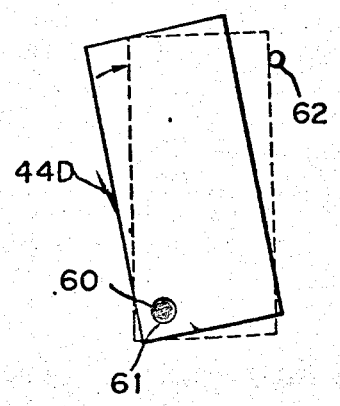

MONEY RECEIVING AND DISPENSING SYSTEM

BRIEF SUMMARY OF THE INVENTION

The present invention relates to a money receiving and dispensing system for use in banks and other services, and more particularly to an improved system in which the monies deposited into the system are stored in a plurality of money cases of corresponding denominations and the monies stored in the respective money cases may be dispensed from the system.

An automatic banking system is well known in which bank notes deposited into the system by a customer are stored in a collection money box, whereas bank notes stored in a plurality of money cases by denomination are dispensed to him or another customer. The money box and cases are removably mounted in the system. In such a conventional automatic banking system, before starting a bank service for any particular day, a clerk puts corresponding notes into all of the money cases in accordance with denominations, brings the money cases containing the notes and the empty collection money box into the system, and sets the system. After closing the bank service for that day, he detaches all the money cases and box from the system and brings them to an accounting manager for calculation. In a bank which is equipped with a large number of such conventional automatic banking systems, it is a troublesome work to carry a great number of money cases and boxes in the above mentioned manner for setting or resetting the systems at the beginning or end of the day's service. Moreover, if most of the notes stored in any of the money cases are dispensed in withdrawal transactions, the particular money case must be refilled with a supplemental supply of corresponding notes and the need for such maintenance work by clerks arises often within a day.

It is, therefore, a primary object of the present invention to provide a money receiving and dispensing system for use in banks or other money-handling services, in which the work involved in carrying money cases for setting and resetting the system is minimal.

It is a further object of the present invention to provide a money receiving and dispensing system which comprises a stock money cartridge removably mounted in the system and a plurality of money cases for storing monies of corresponding denominations, in which monies stored in the money cartridge are transferred into the corresponding money cases on setting the system, or monies stored in the money cases are collected into the money cartridge on resetting the system.

It is a still further object of the present invention to provide a money receiving and dispensing system comprising a stock money cartridge and a plurality of money cases, in which monies deposited into the system are stored by denomination in the money cases, and the monies stored in the money cases may be used for dispensing out of the system to customers or clerks.

It is another object of the present invention to provide a money receiving and dispensing system comprising a plurality of money cases for storing monies of corresponding denominations, in which the maintenance work of clerks relating to the refilling of the money cases with supplemental supplies of monies is simplified and reduced.

According to one aspect of the present invention, there is provided a money receiving and dispensing system comprising a plurality of money cases for storing monies of several denominations, respectivel stock money cartridge removably mounted in the tem for collectively storing monies available in system, a plurality of entering means each for ente monies into the corresponding one of said money c and stock money cartridge, a plurality of feeding me for respectively feeding the monies stored in said mo cases and stock money cartridge, a money receiv means for receiving the money deposited into the tem to store the received money in one of said mo cases and stock money cartridge, and a money dispe ing means for dispensing the money fed by one of s feeding means.

Other objects and advantages of the present invent will be apparent upon reference to the following scription in conjunction with accompanying drawin in which:

BRIEF DESCRIPTION OF DRAWINGS

FIG. 1 is a partial perspective view of a money ceiving and dispensing system in accordance wit preferred embodiment of the present invention;

FIGS. 3A and 3B illustrate modified methods mounting the stock money cartridge which may employed in the system of FIG. 1;

DETAILED DESCRIPTION

Figure 2:
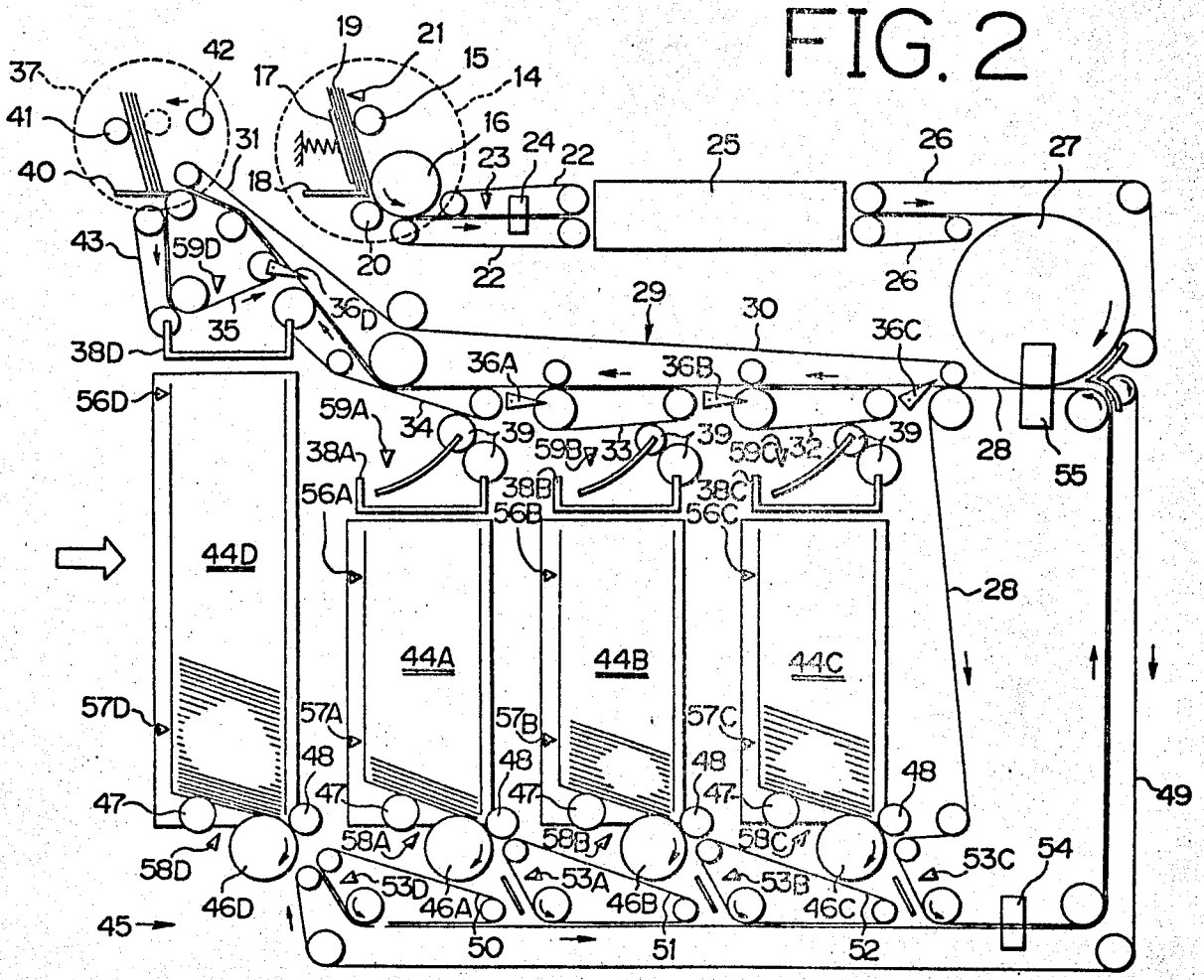
FIG. 2 is a schematic side view of the money rece ing and dispensing mechanism employed in the syst of FIG. 1.

Referring, now, to FIG. 1, there is shown a fron operational panel portion of a money receiving an dispensing system or automatic banking system, as on preferred embodiment of the present invention. A operation manual display 1 indicates to a customer th stepwise operation procedures which must be per formed by him. A card inlet 2 is disposed to receiv cards assigned to registered customers, and the car data recorded on the received card is read out by a car reader disposed within the system (not shown in draw ings). The inlet 2 may be modified to accept bank pas books instead of cards. A receipt outlet 3 is disposed to dispense receipts illustrating transaction details which are issued by a receipt issuing device disposed within the system (not shown in drawings) in deposit or withdrawal transactions. A monetary amount display 4 is disposed to display the monetary amounts which are transacted in deposit or withdrawal transactions. A denomination count display 5 displays the number of sheets of bank notes deposited in a deposit transaction for each denomination. Deposit key 6 and withdrawal key 7 are disposed to designate deposit and withdrawal transactions, respectively. Entry keys 8 including a clear key are disposed to enter the secret numbers assigned to customers, the monetary amounts of withdrawal or others into the system. Denomination designation keys 9 are disposed to designate denominations of bank notes which should be dispensed in withdrawal transactions. An acknowledgment key 10 is depressed by a customer when he wants to acknowledge a deposit transaction without cancelling it on the way. If he wants to cancel the deposit transaction, he must depress a cancel key 11. A note inlet 12 is disposed to accept bank notes which are deposited by customers in deposit transactions. A note outlet 13 is disposed to dispense the bank notes which have been judged as faulty notes in deposit transactions, which should be returned to customers on depressing the cancel key 11, or which should be dispensed in withdrawal transactions.

The money receiving and dispensing system of the above construction is operated by customers as follows:

If a customer wants to perform a deposit transaction, he must first depress the deposit key 6, insert his card into the inlet 2, and enter his secret number through the entry keys 8, whereby the correspondence between the card data and the entered secret number is checked. Next, he deposits notes into the note inlet 12. The deposited notes are taken into the system one by one and checked as to genuineness and denomination. If one of the checked notes is judged as a faulty note in the system, the faulty note is returned through the outlet 13 to the customer. The monetary amount and the numbers of sheets of the deposited notes which have been judged as genuine ones are displayed on displays 4 and 5. If the customer acknowledges such display and depresses the key 10, the deposit transaction is concluded. Then, the card is returned through the inlet 2 and a receipt is issued through the outlet 3 to the customer. On the contrary, if he wants to cancel the transaction on the way and depresses the cancel key 11, the deposit transaction is broken off and all of the deposited notes are dispensed through outlet 13.

If the customer wants to perform a withdrawal transaction, he must first depress withdrawal key 7, insert his card into inlet 2, and enter his secret number through entry key 8. If there exists a predetermined relation between the secret number and the data recorded on the inserted card, the display 1 instructs the customer to designate the monetary amount and denominations of the bank notes for withdrawal through the keys 8 and 9. Upon such depressions of keys 8 and 9, the monetary amount and the numbers of sheets of notes designated by him are displayed on the displays 4 and 5, respectively. If he acknowledges the indications on the displays and depresses the acknowledgment key 10, the withdrawal transaction is concluded. Then, the notes he requested are dispensed through the outlet 13, the card returned and a receipt issued through outlet 3.

Returning to FIG. 2, there is disposed a money receiving and dispensing mechanism which is built into the system of FIG. 1 in association with the note inlet and outlet 12 and 13.

A receiving portion 14 is arranged under the note inlet 12, which includes an eccentric roller 15, a take-in roller 16, a biasing plate 17 for biasing bank notes 19 against the rollers 15 and 16, a bottom plate 18, a friction roller 20 contacting the roller 16, and a receiving sensor 21. For the receiving portion 14 to accept bank notes, the biasing plate 17 is drawn by a certain cam mechanism (not shown in drawings) so as to accept notes 19. If the notes 19 are sensed by the sensor 21, the plate 17 is moved to the original position shown in FIG. 2 so as to bias the notes 19 against the rollers 15 and 16. And then, in response to the revolution of the eccentric roller 15, the accepted notes 19 are taken into the subsequent or downstream section of the mechanism by the take-in roller 16 one after another. The sensor 21 generates an empty signal when all of the notes 19 have passed over the roller 16.

The respective notes 19 taken in by the roller 16 are transported by a first pair of conveyor belts 22 via a note length sensor 23 and a note overlap sensor 24 towards a note checker 25. Said first pair of conveyor belts 22 are driven at a predetermined constant speed by a drive source not shown. The sensor 23 includes a photoelectric sensor, which checks whether the notes 19 fed by eccentric roller 15 one after another onto belts 22 are of a predetermined normal length or of a length greater than said normal length, due to overlapping of two or more sheets, based on the time required for the passage of each note through the sensor 23. The sensor 24 includes a pair of rollers with a gap provided therebetween, said gap being normally of a dimension equal to one and a half times the thickness of notes, and a gauge sensor associated with said pair of rollers so that any overlapping of two or more notes may be detected. The note checker 25 includes a magnetic head, by means of which it reads out the patterns printed on the notes transported into the checker 25 in order to sense the respective denominations and judge the genuineness of the respective notes.

The notes read by the checker 25 are transported to a distributing portion 29 by a transport route comprised of a second pair of conveyor belts 26, a drum 27 and a third conveyor belt 28.

The distributing portion 29 includes a conveyor belt having a first run 30 (hereinafter fourth conveyor belt) and a second run 31 (hereinafter, fifth conveyor belt), sixth, seventh, eighth and ninth conveyor belts 32, 33, 34 and 35 respectively facing the belts 30 and 31, and distributing plates 36A, 36B, 36C and 36D. The plates 36A, 36B, 36C and 36D are actuated by plungers (not shown in drawings) in accordance with the results of checking in the checker 25.

The reference letters A, B, C and D correspond, respectively, to denomination A, denomination B, donomination C and a mixed denomination of bank notes which are available in the present embodiment.

The distributing plates 36A, 36B and 36C are respectively actuated to distribute the corresponding notes having the respective denominations A, B and C. The plate 36D is actuated to distribute the notes of the denomination A, B or C which have not been distributed by any of the plates 36A, 36B and 36C. The above-mentioned conveyor belts 30 to 35 transport the respective notes to be distributed by the distributing plates 36A, 36B, 36C and 36D.

The end of the transport route comprising the fifth and ninth conveyor belts 31 and 35 is connected to a dispensing portion 37 so as to distribute thereto the faulty notes as judged by the checker 25 or the irregularly conveyed notes as sensed by the sensors 23 and 24, which are not distributed by any of plates 36A, 36B, 36C and 36D.

The distributing portion 29, if desired, may be modified so that the notes irregularly conveyed by belts 22 and sensed by the sensors 23 and 24 are directly transported to the dispensing portion 37 without being transported to the checker 25.

Four temporary storage devices 38A, 38B, 38C and 38D are respectively disposed so as to temporarily store the corresponding notes distributed by the respective plates 36A, 36B, 36C and 36D. Thus, the notes taken in by the roller 16 are stored in the devices 38A, 38B and 38C by denomination. A plurality of pairs of guide rollers 39 are disposed to guide the notes towards the devices 38A, 38B and 38C.

The dispensing portion 37, arranged under the note outlet 13, includes a movable bottom plate 40, a driving roller 41 and a driven roller 42. The driven roller 42 is normally in a standby position as shown in solid line where notes are entered between rollers 41 and 42, but in a dispensing mode the roller 42 is moved by a plunger to a dispensing position shown in dot line so as to push the notes toward the roller 41 and have the notes dispensed by the roller 41 which rotates in the dispensing mode.

The plate 40 is adapted to be swung by a plunger clockwise about its left end so that the notes resting on the plate 40 are transported to the device 38D for storage therein by a collecting transport route comprised of a ninth conveyor belt 35 and a tenth conveyor belt 43.

Each of the temporary storage devices 38A, 38B, 38C and 38D has a box-shaped configuration with an opening in an upper portion thereof and a shutter at a bottom portion thereof. The shutter is adapted to be opened by a plunger (not shown) so that the notes stored in the temporary storage device are downwardly released.

Under the temporary storage devices 38A, 38B, 38C and 38D, there are disposed money cases 44A, 44B and 44C and a stock money cartridge or case 44D, respectively. The money cases 44A, 44B and 44C are respectively adapted to store the notes corresponding to the denominations A, B and C, for example, 10-dollar bill, 20-dollar bill and 100-dollar bill, and fixed to the present system. The stock money case 44D, having a larger storage capacity than any one of the cases 44A to 44C, is removably mounted in the system and is adapted to store the notes of all denominations available to the system, viz. denominations A, B and C. Usually, however, notes are received by the stock money case 44D and stacked therein in layers each consisting of many notes as supplied at the beginning of the day's bank service or transferred from each of the money cases, for instance, so that the time of distribution by said distributing plates 36A, 36B and 36C into the money cases 44A, 44B and 44C is reduced.

Below the cases 44A to 44D, there is disposed a feeding portion 45 which includes feeding rollers 46A, 46B, 46C and 46D for feeding notes, four eccentric rollers 47 for preventing notes from being overlapped, and four friction rollers 48 respectively in contact with the corresponding rollers 46A to 46D. The feeding portion 45 further includes a feeding transport route comprising eleventh conveyor belt 49, twelveth, thirteenth a fourteenth conveyor belts 50, 51 and 52 respectiv confronting the belt 49, and the third conveyor belt which transports the notes fed from the respecti money cases 44A through 44D toward the distributi portion 29 for conveyance to the dispensing portion Moreover, the feeding portion 45 includes note leng sensors 53A, 53B, 53C and 53D and a note overl sensor 54.

The note length sensors 53A, 53B, 53C and 53D spectively comprised photoelectric sensors and adapt to sense the length of the notes fed by the respecti feeding rollers 46A, 46B, 46C and 46D. The sensc 53A through 53D may be replaced with a single nc length sensor disposed near the note overlap sensor if desired. The note overlap sensor 54 has a constructi similar to that of the above-mentioned sensor 24 and adapted to sense two or more notes overlapping ea other. At a receiving end of the distributing portion there is disposed a note reviewer 55 for sensing t notes passing therethrough by denomination whi includes a magnetic head or a photoelectric sensi head.

The cases 44A, 44B, 44C and 44D respectively a equipped with detecting and generating means. In th embodiment, this means comprises maximum stora sensors 56A, 56B, 56C and 56D, minimum storage se sors 57A, 57B, 57C and 57D and empty storage senso 58A, 58B, 58C and 58D, each of said sensors generatir the corresponding output signals. The maximum sto age sensors 56A to 56D respectively sense that t heights of notes in the respective cases 44A to 44D ha reached respectively predetermined maximum level The minimum storage sensors 57A to 57D respective sense that the heights of notes in the respective cas have decreased to respectively predetermined minimu levels. The empty storage sensors 58A to 58D respe tively sense that the respective cases contain no note Temporary storage sensors 59A, 59B, 59C and 59D a respectively disposed to sense that the respective ten porary storage devices 38A, 38B, 38C and 38D contai no notes.

The sensors 56(A to D), 57(A to D), 58(A to D) an 59(A to D) comprise photoelectric sensors or snap a tion switches, and may be disposed inside or outside th respective cases 44(A to D).

The stock money case 44D is mounted in the syste by sliding the case 44D horizontally along the arrow mark and may be removed from the system by pullin the same in the reverse direction. Other modifie mounting methods for the case 44D are illustrated i FIGS. 3A and 3B.

In FIG. 3A, the case 44D provided with two holes 6 is mounted in an oblique position by engaging ther with a pair of projecting pins 60. In FIG. 3, there i illustrated another modified mounting method for th case 44D which is provided with a single hole 61 en gageable with a projecting pin 60 and is supported by stopper 62.

Figure 5:
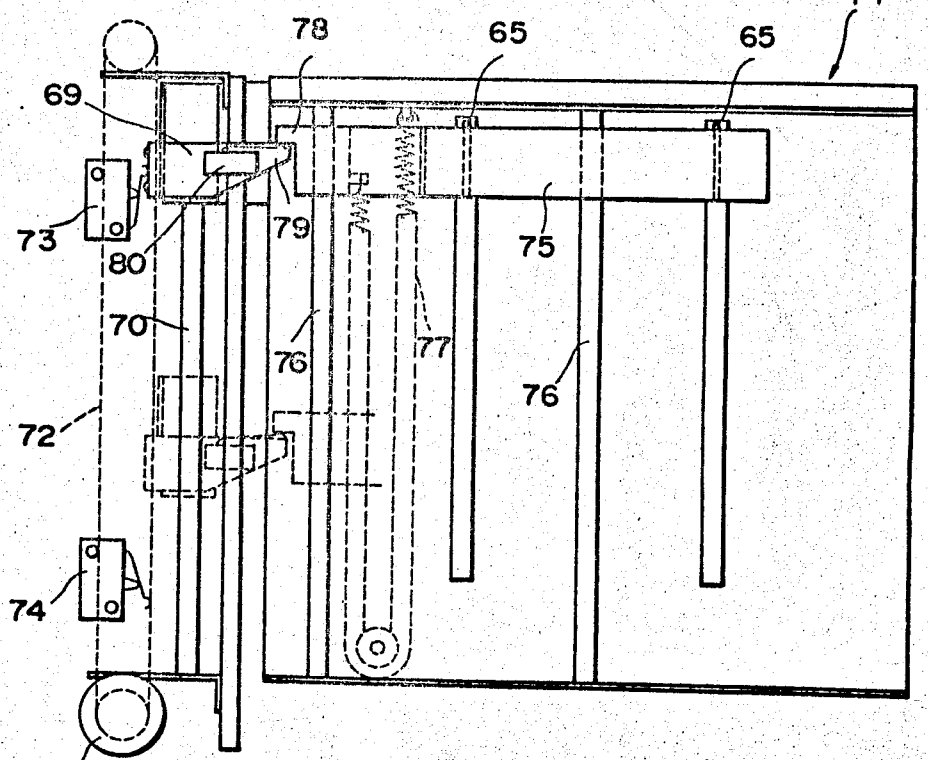
FIG. 5 is a front view of the money cartridge or ca of FIG. 4.
Figure 4:
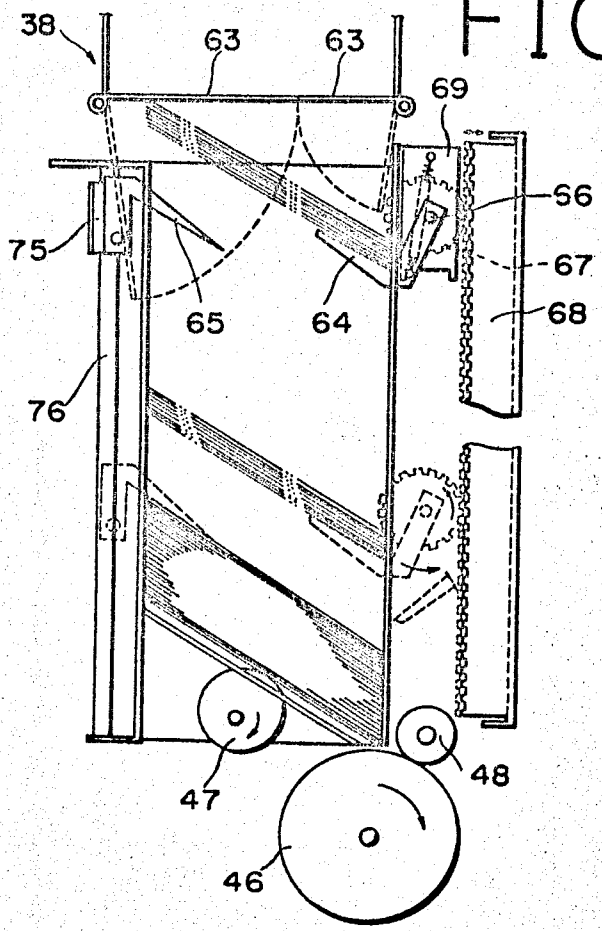
FIG. 4 is a side view, with the wall removed, of t money cartridge or case employed in the mechanism FIG. 2.

In FIGS. 4 and 5, there is illustrated one of the mone cases 44A, 44B, 44C and 44D associated with the tem porary storage devices 38A, 38B, 38C and 38D. I should be understood that all these cases have the sam construction and that all the temporary storage device have the same construction.

As mentioned above, the temporary storage devic 38 (38A, 38B, 38C, or 38D) has a shutter consisting of pair of bottom plates 63 which are adapted to be closed or downwardly opened by a plunger or cam mechanism. The plates 63 respectively have free end edges in the shape of the teeth of a comb so that as the plates 63 have been fully opened downwardly, the plates 63 may be in a position outside the corresponding money case 44 (44A, 44B, 44C, or 44D) by passing through a cut-out portion formed in a side wall of the case 44 and the notes temporarily stored in the device 38 may be dropped into the case in a lump.

Within the case 44 there are housed a pair of supporting levers 64 for supporting notes in an oblique position and a pair of push levers 65 for retaining the notes in that position in cooperation with the levers 64. The supporting levers 64 are fixed at the base ends thereof to a shaft 66 supported by a vertically movable frame 69 outside of the case 44. To the shaft 66 there is also fixed a pinion 67 so that the supporting levers 64 may swing in response to the rotation of pinion 67 from a supporting position indicated in solid lines within the case 44 into a release position indicated in broken lines which is outside of the case 44. And for this purpose, the wall of the case 44 is provided with a hole for the movement of the lever 64. A rack 68 is driven by a plunger either to engage with the pinion 67 or disengage therefrom. Thus, in response to the vertical movement of the frame 69 the pinion 67 is rotated clockwise or counterclockwise by the rack 68 in an engaging relationship with the pinion 67.

The frame 67 is guided by a rod 70 and is driven in an optionally upward or downward direction by a motor 71 through a belt 72 fixed to the frame 67. Upper and lower limit switches 73 and 74 are respectively disposed to sense the highest and lowest limit elevations of the frame, and to accordingly control the motor 71.

The push lever 65 is fixed to a supporting frame 75 which is guided by a rod 76 and biased downwardly by a spring 77. The frame 75 is engaged at a projection 78 thereof with an upper surface of a projection 79 of the vertically movable frame 69 and is prevented from being depressed downwardly by the spring 77. Therefore, in response to the downward movement of the frame 69, the frame 75 moves downwardly. And, if the lever 65 comes in contact with the notes stored therein, the frame 75 is blocked and departs from the frame 69. A switch 80 is disposed to sense such departure and control the rack 68.

Operations for storing the notes temporarily detained in the storage device 38 into the case 44 will be described hereinafter. First, the levers 64 and 65 are in a highest position, and as the bottom plates 63 are fully opened downwardly, the lever 64 receives the notes from the device 38. In response to the revolution of the motor 71, the levers 64 and 65 move downwardly, but when the lever 65 comes in contact with the uppermost one of the already stored notes in the case 44, the switch 80 is actuated to generate an output signal and causes the rack 68 to be driven into contact with the pinion 67. For a predetermined time period after the generation of the output signal from the switch 80 the frame 69 moves downwardly, but the pinion 67 is rotated so as to move the lever 64 to the outside of the case 44. The lever 64 is kept outside of the case 44 and the rack 68 departs from pinion 67. Then, the notes supported by the lever 64 are dropped on the previously stored notes in the case 44. In response to a reverse revolution of the motor 71, the frame 69, together with the lever 65, moves upwardly allowing the notes deposited on the lever 65 to slip down to the bottom of case 44. In response to a normal revolution of the motor 71, the push lever 65 together with frame 69 moves downwardly to a feeding position where the lever 65 pushes the stored notes downwardly.

In order to change the position of the levers 64 and 65 from said feeding position to the initial position, the frames 69 and 75 are moved upwardly by motor 71, the switch 73 is actuated by frame 69, the rack 68 comes in contact with pinion 67 in accordance with an output signal generated from switch 73, the supporting lever 64 moves into the case 44, and the rack departs from pinion 67. Now, the levers 64 and 65 are ready to receive the subsequent notes that may have been stored in the device 38.

Figure 6:
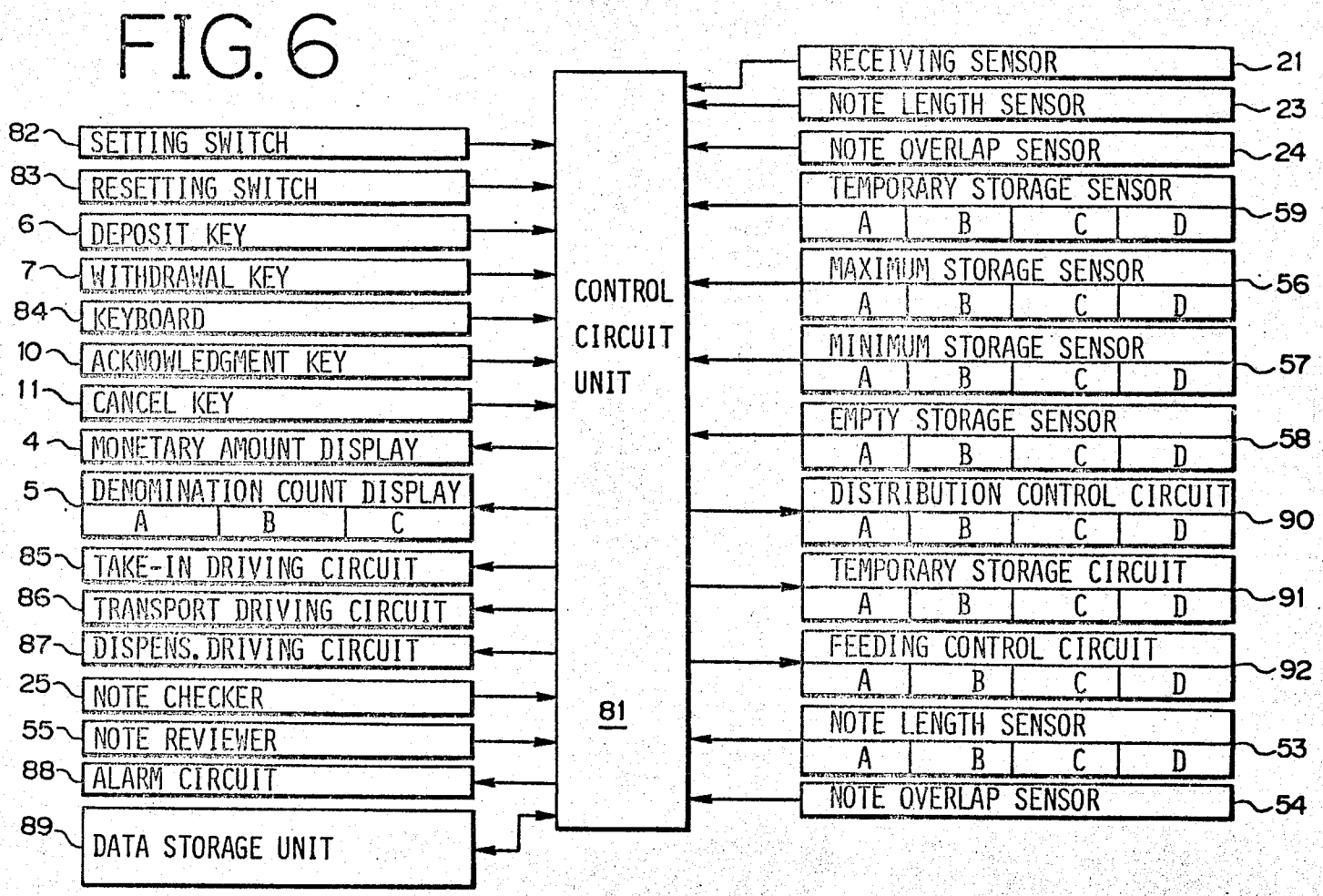
FIG. 6 is a schematic block diagram illustrating t system of FIG. 1.

FIG. 6 is a schematic block diagram of the system of FIG. 1. A control circuit unit 81 is disposed to control the associated circuits and devices under a control program stored in a storage unit (not shown).

A setting switch 82 is actuated by a bank clerk when he wants to initiate depositing and withdrawal transaction bank services. In response to a set signal generated from the switch 82, the notes stored in the stock money cartridge 44D begins to be transferred into the corresponding money cases 44A, 44B and 44C.

A resetting switch 83 is actuated by a bank clerk when he wants to close bank services for the day. In response to a reset signal generated from the switch 83 all of the notes stored in the money cases 44A to 44C starts being collected into the money cartridge 44D. The switches 82 and 83 are disposed in the system.

A keyboard 84 includes the entry keys 8 and denomination designation keys 9. A take-in driving circuit 85 is disposed for driving the eccentric roller 15 and take-in roller 16 within the receiving portion 14.

A transport driving circuit 86 is disposed to drive the conveyor belts 22, 26, 28, 30 to 35, 43, 49 to 52. A dispensing driving circuit 87 is disposed to drive the driving roller 41 and driven roller 42 within the dispensing portion 37.

An alarm circuit 88 is disposed to inform the bank clerk of various abnormal statuses in the system, such that the money cartridge 44D contains notes over a maximum storage capacity and should be replaced with another empty stock money cartridge, or the like. The alarm unit which is activated by the circuit 88 is disposed in the system, but may be disposed in a remote monitor unit.

A data storage unit 89 is disposed to store the input and output data processed in the system.

A distribution control circuit 90 is disposed to drive the respective driving plates 36A to 36D. A temporary storage control circuit 91 is disposed to control the opening and closing movements of the bottom plates 63 of the temporary storage devices 38A to 38D. A feeding control circuit 92 is disposed to drive the feeding rollers 46A to 46D and eccentric rollers 47.

Figure 7:
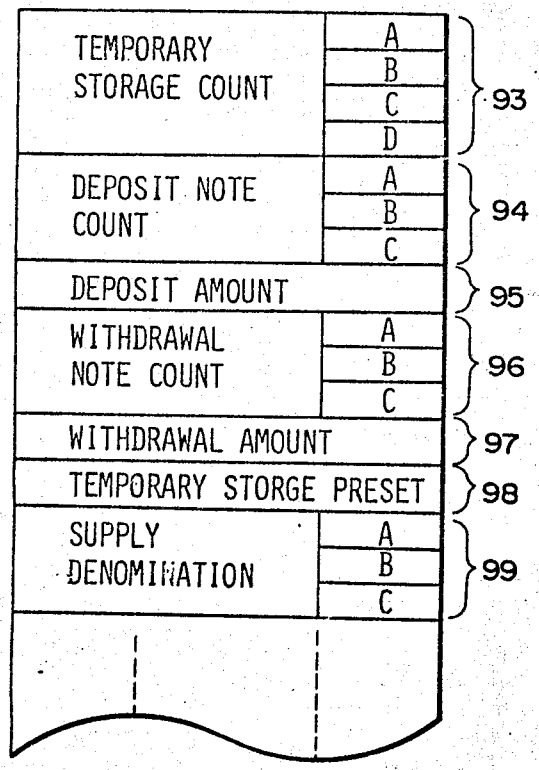
FIG. 7 is a schematic block diagram illustrating t storage areas of the data storage unit employed in t system of FIG. 6.

Referring to FIG. 7, there are illustrated the storage areas of the data storage unit 89. The data storage unit 89 includes a temporary storage count area 93 having sections A, B, C and D for storing data on the respective numbers of sheets of the notes temporarily retained in the respective temporary storage devices 38A to 38D, a deposit note count area 94 having sections A, B and C for storing data on the number of sheets of the deposited notes for each denomination in a deposit transaction with the customer, a deposit amount area 95 for storing data on the deposit monetary amount in the deposit trasaction, a withdrawal note count area 96 having sections A, B and C for storing data on the number of sheets of notes requested by the customer for each denomination, a withdrawal amount area 97 for storing data on the withdrawal monetary amount in the withdrawal transaction, a temporary storage preset area 98 for presetting predetermined maximum numbers (e.g. 100) of sheets of the notes available for storage in the respective temporary storage devices 38A to 38D, and a supply denomination area 99 having sections A, B and C for storing flags representing the respective money supply signals generated from the respective sensors 57A to 57C when the heights of notes stored in the respective cases 44A to 44C have dropped to the respective predetermined minimum levels.

Operations for the money receiving and dispensing system having the above construction will be described hereinafter. The system in the present embodiment has a standby, a setting, a resetting, a deposit, a withdrawal and a refilling mode.

Figure 8:
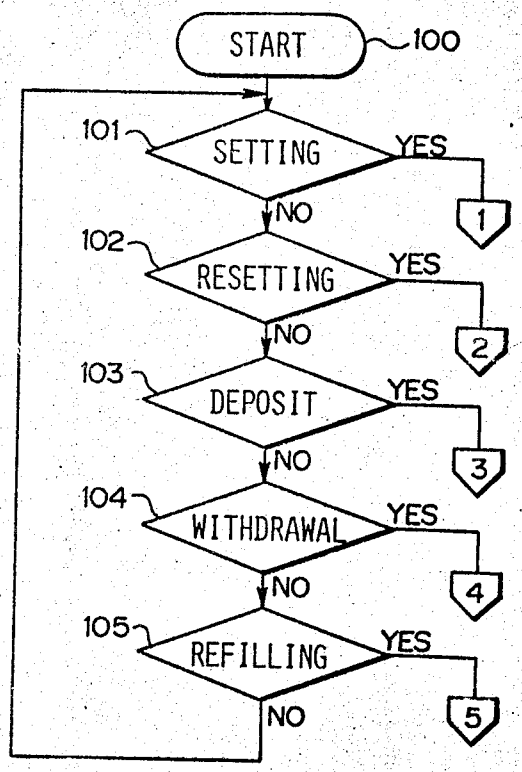
FIG. 8 is a flow chart illustrating the operation of t system in a standby mode shown in FIG. 1.

In FIG. 8, there is shown a flow chart illustrating operation of the system in the standby or waiting mode. Upon switching on a main power switch (not shown) of the system, the control circuit unit 81 cyclically searches which mode should be performed by the system in accordance with a routine between steps 101 and 105.

In the step 101, the control circuit unit 81 inquires if there is available a set signal from the setting switch 82 which is manipulated by the bank clerk for setting the system into operation. If there is a set signal, the system is switched to the setting mode illustrated in FIG. 9.

In the step 102 the unit 81 inquires if the operation for resetting the system is requested in accordance with a reset signal from the resetting switch 83. If requested, the system is switched to the resetting mode illustrated in FIG. 10.

In the step 103, the unit 81 inquires if the operation for a deposit transaction is requested by depression of the deposit key 6. If it is requested, the system is switched to the deposit mode illustrated in FIG. 11.

In the step 104, the unit 81 inquires if the operation for a withdrawal transaction is requested by depression of the withdrawal key 7. If it is requested, the system is switched to the withdrawal mode illustrated in FIG. 12.

In the step 105, the unit 81 inquires if the operation for refilling any of the cases 44A to 44C with additional notes is requested in accordance with the corresponding money supply signal generated from the sensors 57A, 57B or/and 57C. If it is requested, the system is switched to the refilling mode illustrated in FIG. 13.

Returning to FIG. 9, there is illustrated a flow chart for completing the setting operations for the system. Normally, there is not a single note in the system before starting a bank service for any particular day because all of the notes previously stored in the system have been taken out from the system at closing of the previous day's service. If the clerk wants to start a bank service in the system for that day, he first turns on the main power switch and mounts the stock money case 44D containing the notes of all denominations A, B and C into the system at the feeding portion 45. Then, he actuates the setting switch 82 so as to advance the sequence from step 101 to step 106.

The control circuit unit 81 inquires if the temporary storage devices 38A to 38D and the cases 44A to 44C are empty, based on the respective output signals generated from the sensors 59A to 59D and 58A to 58C (steps 106 and 107). If the existence of notes within the devices or cases is sensed, the sequence flows to a step 131 and stops there. In the step 131, the alarm circuit 88 generates an abnormal status signal so as to inform the clerk that one of the devices 38A to 38D and the cases 44A to 44C contains a note or notes and that such residual note or notes should be removed by the clerk. If they are removed, the sequence of the system returns to the step 106.

If the devices 38A to 38D and the cases 44A to 44C are empty, the sequence flows to a step 108 where the case 44D is confirmed to contain notes, and further advances to a step 109 where the transport driving circuit 86 drives the corresponding conveyor belts and the feeding control circuit 92 drives the feeding roller 46D for feeding notes one after another from the case 44D. the fed notes from the case 44D are checked by the sensor 53D with respect to their lengths, checked by the sensor 54 with respect their thicknesses, and checked by the reviewer 55 with respect to their denominations (steps 110 and 111).

If an abnormal feeding is sensed in step 110 or an abnormal note is sensed in step 111, the sequence advances from the step 110 or 111 to a step 130. In the step 130, the abnormally fed note or the abnormal note is transported to the temporary storage device 38D by the distributing lever 36D which is driven by the distribution control circuit 90, and information on the number of sheets of notes retained in the device 38D is stored in the temporary storage count area 93 at the section D. The abnormal note sensed in the step 111 is a note which cannot be dispensed to the customer, such as a faulty note, a note having a denomination other than the available denominations, a crumpled note, an inky note, or the like. If desired, the system in the present embodiment may be modified to further include a collection box and a transport mechanism for forwarding such a note to the collection box, whereby such an abnormal note may be collected into the collection box. The collection box containing abnormal notes may be detached by the clerk.

If the notes are delivered from case 44D onto belt 49 in an orderly and normal condition and, also, are wholesome, they will be distributed to the respective temporary storage devices 38A to 38D by denomination. For instance, if a note fed from the case 44D is judged as one of denomination A by the note reviewer 55 (step 112) and, the case 44A is found not full by the sensor 56A (step 113), the distributing plate 36A is driven by the distributing control circuit 90 so as to transfer the note of denomination A into the device 38A (step 114). Then, the note transferred to the device 38A is counted by the count area 93 at the section A, and the control unit 81 inquires if the current number of sheets retained in the device 38A is below a predetermined maximum number data stored in the preset area 98 (step 115). If the current number is below the maximum number, the sequence returns to the step 108 and subsequent notes are fed from the case 44D. The above sequence is repeated until the number of sheets of the notes retained in the device 38A reaches the preset maximum number. If the number of sheets of the notes reaches the maximum number (step 115), the feeding operation from the case 44D is suspended (step 116). Then, the notes retained in the device 38A are dropped into the case 44A, and the number information stored in the count area 93 at the section A is reset to zero to deal with a subsequent temporary storage (step 117). If the case 44A becomes full of notes and a money maximum signal is generated from the sensor 56A (step 113), the subsequent notes of denomination A are retained in the device 38D (step 130).

The operations for transporting the respective notes of denominations B and C from the case 44D to the cases 44B and 44C are performed in the same manner as described above with reference to the sequence for the denomination A (steps 118 to 123 and steps 124 to 129). If all of the notes stored in the case 44D are distributed into the cases 44A, 44B and 44C and the device 38D, the sensor 58D senses that the case 44D is empty (step 108). Then, the operation for feeding notes from the case 44D is stopped (step 132) and all the operations on the setting mode are completed (step 133). In the step 133, the alarm circuit 88 generates a signal to inform the clerk of the completion of the setting mode.

In the step 132, even if several notes are still retained in the device 38D the count area 93 at the section D is reset to zero. It will be apparent that if the numbers of note originally stored in the case 44D, i.e. before mounting the case 44D into the system, are not more than the respective maximum numbers of notes for cases 44A to 44C, the device 38D will not be holding any note at the completion of the setting mode.

Figure 10:
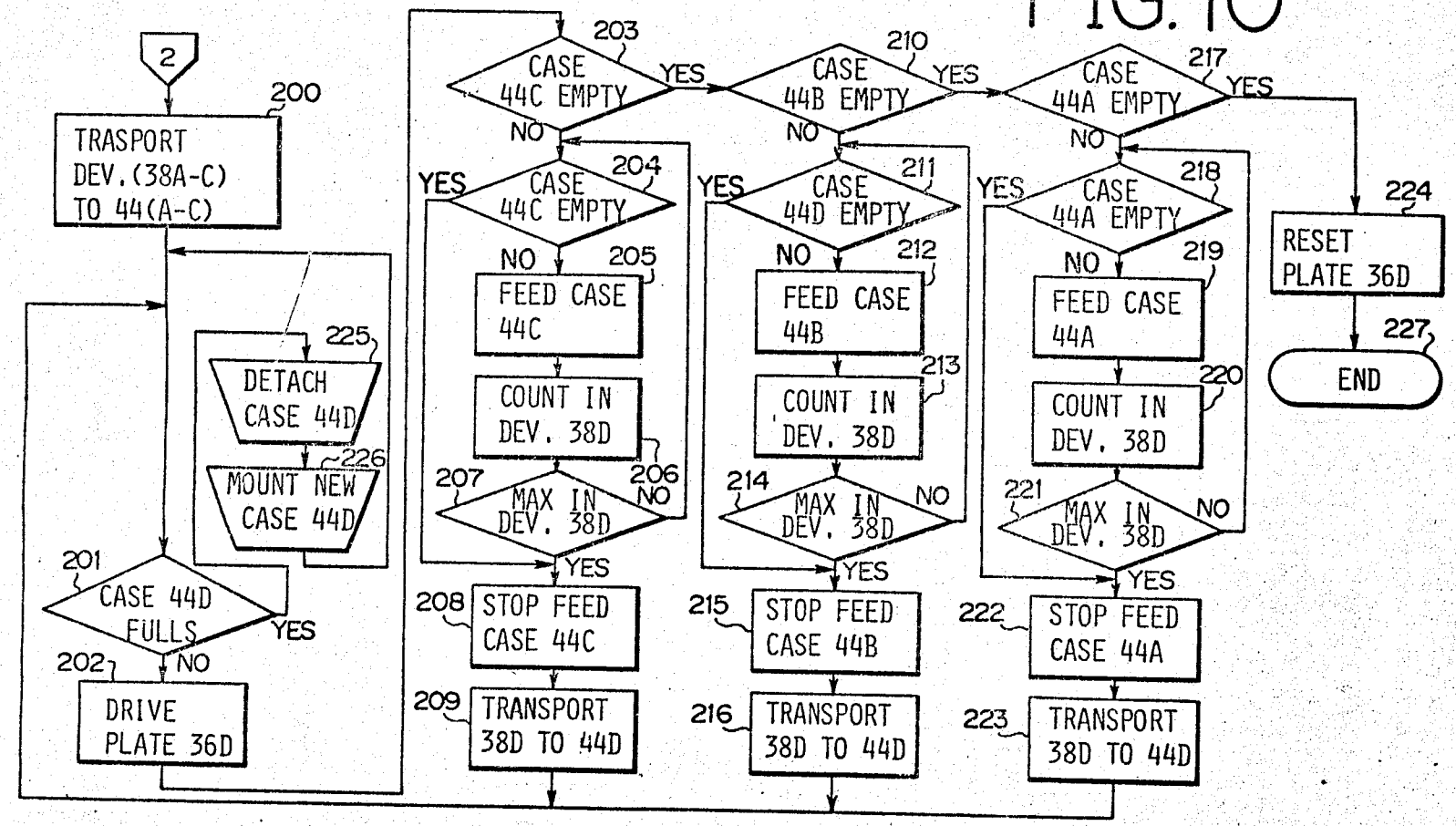
FIG. 10 is a flow chart illustrating the operation the system in a resetting mode shown in FIG. 8.

Referring to FIG. 10, there is illustrated a flow chart for completing the resetting operations by which all of the notes stored in the cases 44A to 44C and the devices 38A to 38D are transported to the case 44D.

If the clerk wants to close the bank service for the day, he actuates the resetting switch 38. Then, the transport driving circuit 86 drives the respective conveyor belts for conveyance of notes, and the sequence flows from the step 102 of FIG. 8 to step 200. If a deposit transaction has been performed prior to the step 200 and the deposited notes are retained in the corresponding devices 38A to 38C, in response to signals from sensors 59A to 59C they are dropped from the devices 38A to 38C into the cases 44A to 44C, respectively (step 200).

The sequence from the step 200 flows to a step 201 where the unit 81 inquires if the case 44D is full of notes. If the case 44D is full, the clerk is informed or it by the alarm circuit 88 and the full case 44D is replaced with an empty case 44D (steps 225 and 226). If the case 44D is not full (step 201), the distributing plate 36D is driven so as to distribute notes into the device 38D (step 202). Then, the unit 81 inquires if the case 44C is empty (steps 203 and 204). The device 38C is empty because it has been emptied in the step 200.

If the case 44C is not empty, the feeding roller 46C is driven by the feeding control circuit 92 so as to transfer the note or notes from the case 44C to the device 38D (step 205). Based on the output signals generated from the reviewer 55, the sheets of notes retained in the device 38D is counted and the number information is stored in the count area 93 at the section D (step 206).

If the number of sheets of the notes retained in the device 38D reaches the maximum number (e.g., 100) preset in the area 98 (step 207), the feeding roller 46C is stopped by the circuit 92 (step 208) and the notes retained in the device 38D are dropped into the case 44D upon energization of the circuit 91 (step 209). At the same time the count area 93 at the section D is reset to zero. The sequence from step 201 to step 209 is repeated until the case 44C is found to be empty by sensor 58A, each such sequence corresponding to said maximum number of notes preset in area 98, i.e. the transport of, for example, 100 sheets of notes from 44C to case 44D.

When all of the notes in the case 44C have been transported to the case 44D, the sequence flows from step 203 to step 210. When all of the notes stored in the case 44B have been transported to the case 44D in the same manner as described for the case 44C (steps 210 to 216, steps 201 to 203), the sequence flows from step 210 to step 217. Likewise the notes stored in the case 44A are transported to the case 44D (steps 217 to 223), and the sequence flows from the step 217 to a step 224.

In the step 224, when all the notes stored in the cases 44A to 44C and devices 38A to 38C have already been transported to the case 44D, the distributing plate 36D is reset by the control circuit 90, the data storage unit 89 is reset except the area 98, and the circuit 88 informs the clerk of the completion of all resetting operations. The flow chart illustrated in FIG. 10 may be modified so that the YES response to the step 204 or 211 causes the sequence to jump to the step 210 or 217.

Figure 11:
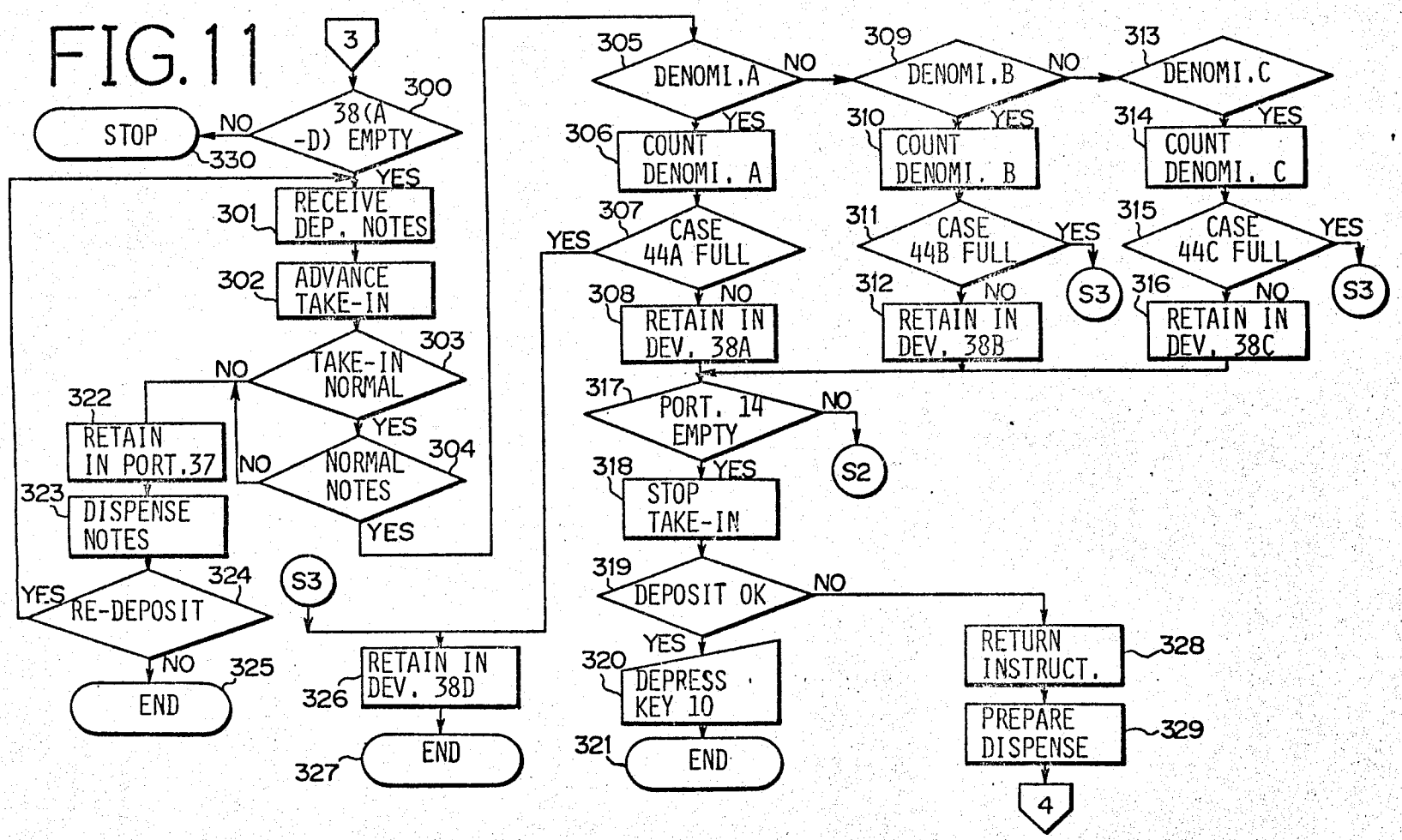
FIG. 11 is a flow chart illustrating the operation the system in a deposit transaction mode in FIG. 8.

In FIG. 11 there is illustrated a flow chart for operations of the system in a deposit transaction mode. If a customer depresses the deposit key 6, the sequence is shunted from the step 103 of FIG. 8 to the flow chart of FIG. 11. Then, he inserts his card into the inlet 2.

In the deposit transaction mode of the system, the notes deposited into the system are retained in the devices 38A to 38C or the device 38D and the number-by-denomination data are stored in the count area 93 until a subsequent transaction is initiated. Thus, when a key is depressed or a card inserted in the next transaction, the deposited notes are transported to the respective cases 44A to 44D and the count area 93 is reset to zero. The above retention of deposited notes and the storage of data are for confirming the deposited notes when a trouble occurs between the band and customer.

Therefore, upon insertion of the card into the inlet 2, the notes previously retained in the devices 38A to 38D, if any, are transported to the respective cases 44A to 44D. Then, the sequence flows to a step 300.

If notes exist in any of the devices 38A to 38D, the circuit 88 generates a signal to inform the clerk that the existing note or notes should be removed from the devices (step 330). Then, he removes the notes, whereupon the sequence returns to the step 300.

If the devices 38A to 38D are empty, the customer is instructed by display 1 to deposit his notes into the inlet 12 in a lump (step 301). The deposited notes are taken one after another into the downstream mechanism by the take-in roller 16 which is driven by the driving circuit 85 (step 302). The notes taken in by the roller 16 are checked by the note length sensor 23 and the note overlap sensor 24 (step 303), and sensed by the checker 25 with respect to their genuineness and denominations (step 304).

If the notes are abnormally taken in or are faulty notes, the sequence flows to a step 322 where the notes are temporarily retained on the plate 40 of dispensing portion 37. Then, the abnormal notes are returned to the customer by the rollers 41 and 42 which are driven by the circuit 87 (step 323). If the customer deposits his notes into the inlet 12 again, the sequence returns to the step 302, whereas if he does not deposit any note a second time, the deposit transaction is terminated (steps 324 and 325).

If the deposited notes are genuine and acceptable to the system (step 304). And based on the signal from checker 25, they are sensed by denomination (step 305, 309 or 313) and the respective number data are stored in the deposit note count area 94, i.e. at the sections A, B and C, and the total amount of the deposited notes is memorized in the amount area 95 (step 306, 310 or 314).

If the case 44A, 44B or 44C is full of notes (step 307, 311 or 315), the corresponding plate 36A, 36B or 36C and the plate 36D are driven by circuit 90 so as to distribute the notes to the device 38D (step 326).

If the case 44A, 44B or 44C is not full (step 307, 311 or 315), the deposited note of denomination A, B or C is distributed into the device 38A, 38B or 38C by the plate 36A, 36B or 36C (step 308, 312 or 316). At the same time, the respective numbers of sheets of notes retained in the devices 38A to 38D are memorized in the count area 93.

The above-mentioned sequence is operated or repeated until the sensor 21 senses that the receiving portion 14 is empty (step 317). If the receiving portion 14 feeds out all notes, the take-in operation in the portion 14 is stopped (step 318).

Then, the customer is requested to decide if he will acknowledge the deposit transaction (step 319). If he agrees to depress the acknowledgment key 10, the subsequent operations for the deposit transaction are performed and completed (steps 320 and 321). If the step 321, the card is returned to the customer, a receipt is issued, and the storage areas 94 and 95 are reset to zero.

In the step 319 the inquiry is made if the deposit transaction can be further advanced, e.g. whether the customer has depressed the cancel key 11, whether a malfunction has occurred within the system or whether the central processing unit has instructed the system to reject the deposit transaction for the reason that the customer's account is no longer valid. If, for example, the cancel key 11 has been depressed, the sequence flows to steps 328 and 329, where the system is prepared for return of the deposit amount to the customer. Then, the sequence will flow to a step 401 of FIG. 12. The notes returned to the customer are fed out from the corresponding cases 44A to 44C in accordance with the number data stored in the area 94 and the deposit amount information stored in the area 95, just as the in the operations for a withdrawal transaction which is described hereinafter. If the complains about the returned notes, the clerk compares the returned notes with the notes retained in the devices 38A to 38D for resolving his complaint.

Figure 12:
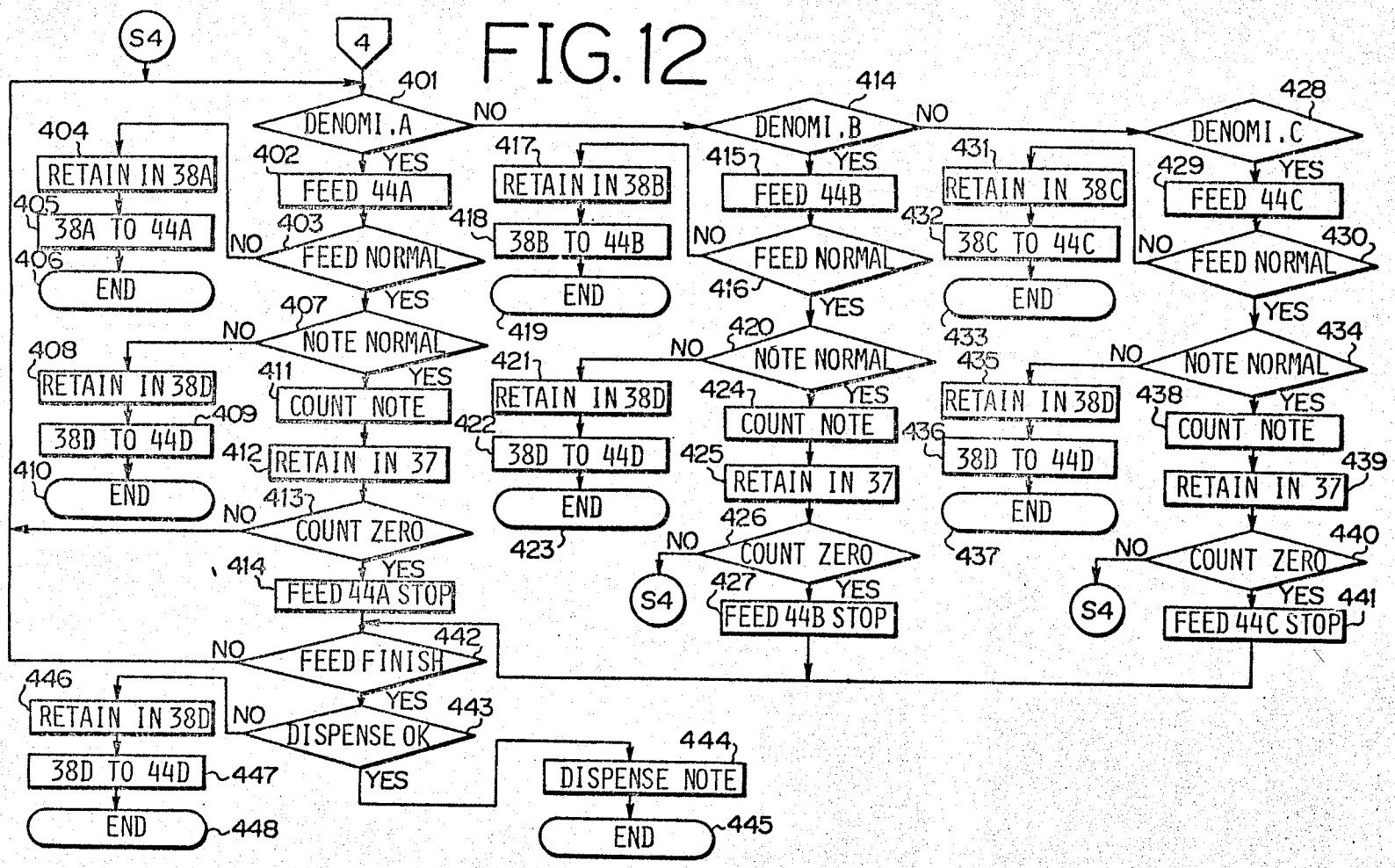
FIG. 12 is a flow chart illustrating the operation the system in a withdrawal transaction mode shown FIG. 8.

In FIG. 12 there is illustrated the operations for performing a withdrawal transaction in the system. Upon depression of the withdrawal key 7 by a customer, the system is switched from the step 104 of FIG. 8 to a flow chart of FIG. 12. Then, he inserts his card into the inlet 2 and enters his secret number through keyboard 84. Further, he enters the amount of withdrawal money with 2 designations of denominations through the keyboard 84. The entered withdrawal amount and denominations are memorized in the storage areas 96 and 97 and a signal representing that his withdrawal transaction is acceptable or unacceptable is transmitted to the system from the central processing unit. If his transaction is acceptable, the transport driving circuit 86 drives the associated conveyor belts.

If the customer designates the denomination A, the feeding roller 46A is driven to feed the notes of denomination A from the case 44A (steps 401 and 402). Whether the feeding is normal is checked by the sensors 53A and 54 (step 403).

If notes overlapping each other are sensed in the step 403, the distributing plate 36A is driven by circuit 90 so as to distribute the overlapping notes into the devices 38A (step 404). The notes distributed into the device 38A are returned to the case 44A (step 405).

As noted are fed from the case 44A, they are confirmed by the reviewer 55 to be of denomination A (step 407). If the note sensed by the reviewer 55 is judged as a different denomination note or a faulty note (step 407), the plate 36D is driven by circuit 90 so as to retain the note in the device 38D and return it to the case 44D (steps 408 and 409).

If the feeding of the note from the case 44A and its denomination are judged to be normal and correct (step 407), the note is retained in the dispensing portion 37 and the counted number stored in the count area 96 at the section A is decreased by one (steps 411 and 412).

Thus, the notes of denomination A are subsequently transported from the case 44A to the portion 37 until the counted number of sheets stored in the area 96 at the section A becomes zero (step 413). Then, the roller 46A is stopped (step 414). The operations for feeding the notes of denomination B or C are performed in the same manner as described above for notes of denomination A (steps 414 to 427 or steps 428 to 441).

If notes of the denominations designated by the customer are supplied to the dispensing portion 37, viz. the respective numbers of sheets memorized in the storage 96 at the respective sections A to C become zero (step 442), it is inquired if the system is ready for dispensing notes from the dispensing portion 37 (step 443).

If the system is not ready for dispensing the notes from portion 37 (step 443) due to the malfunction of a receipt issuing machine or a printer, the bottom plate 40 opens downwardly and the notes retained on the plate 40 are transported to the device 38D (step 446). And the notes retained in the device 38D are transported to the case 44D (step 447). If the system is ready for dispensing the notes from the portion 37 (step 443), the rollers 41 and 42 are driven to dispense the notes through the outlet 13 (step 444). At the same time, the card is returned, a receipt is issued, and the storage areas 96 and 97 are reset to zero.

Figure 13:
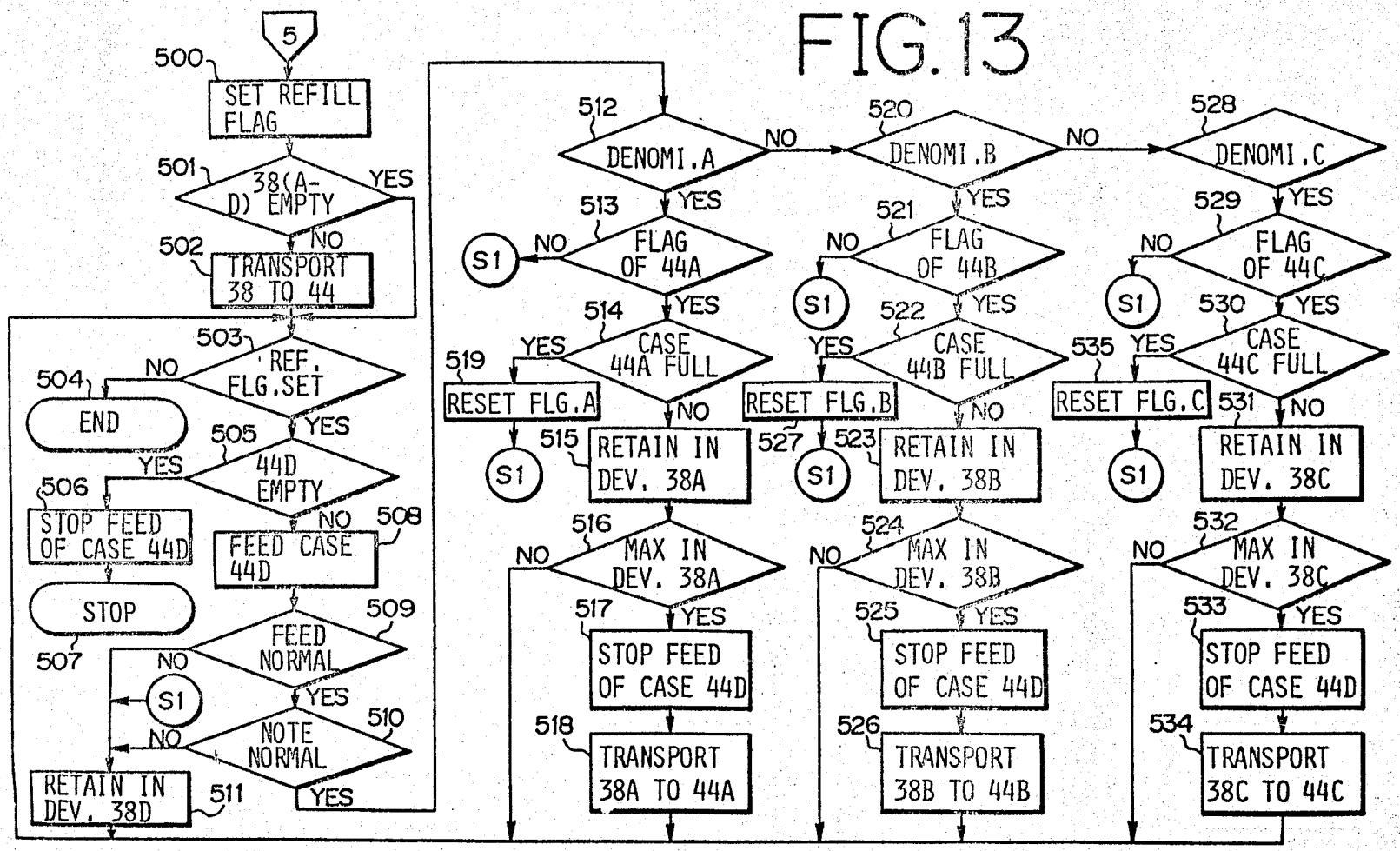
FIG. 13 is a flow chart illustrating the operation the system in a supplement mode shown in FIG. 8; an FIG. 14 is a schematic side view illustrating a mone receiving and dispensing mechanism as another embod ment of the present invention.

Referring to FIG. 13, there are illustrated the operations for refilling notes into empty case or cases (44A, 44B, 44C or 44D). If the heights of notes stored in the respective cases 44A to 44C have decreased to the predetermined minimum levels, the respective sensors 57A to 57C generate money supply signals which are to be detected by the circuit unit 81 (step 165), and refilling flags are set in the supply denomination area 99 at the respective sections A to C (step 500).

In a step 501 it is inquired if the respective devices 38A to 38D are retaining notes. If notes are retained in the devices, the notes are transferred to the corresponding cases (44A to 44D) in accordance with signals from the circuit 91 (step 502).

The operations for refilling the system are basically the same as those for setting the system except the operations by which notes are transported into the case lacking in notes or the sequence is terminated when the case 44D becomes empty.

If the devices 38A to 38D are all empty (step 501) and a flag is set in the storage area 99 (step 503), the circuit 92 drives the associated conveyor belts and the feeding roller 46D is driven so as to feed the notes stored in case 44D (step 508). The fed notes consist of various denominations of notes and must be sensed by denomination. The respective fed notes are checked with respect to their lengths and thicknesses by the sensors 53 and 54

(step 509), and sensed with respect to their denominations (step 510) by the reviewer 55.

If the feeding and denomination of the fed note is wholesome, the sequence flows to a step 511 where the fed note is delivered into the device 38D by the plate 36D. If the fed notes are fed in an orderly condition and also normal notes, the sequence will flow to step 512, 520 or 528 according to the denominations sensed by the reviewer 55. If the note sensed by the reviewer 55 has denomination A and the flag is set at the section A of the storage area 99, the driving plate 36A is driven to distribute the note into the device 38A (steps 512, 513, 514 and 515).

The operations for feeding the notes of denominations B and C are performed in the same manner as described for denomination A. The numbers of sheets of notes retained in the respective devices 38A to 38D are memorized in the storage area 93 at the respective sections A to D. If each note fed out from the case 44D corresponds to the denomination for which the flag has been reset in the storage 99, it is retained in the device 38D because the case corresponding to the reset flag is not necessary to be refilled with the notes (step 511).

For instance, if the number of sheet of notes retained in the device 38A reaches the predetermined number (e.g. 100) (step 516), the feeding roller 46D stops (step 517) and the notes retained in the device 38A are transported to the case 44A (step 518). A similar series of operations are performed for the device 38D. Upon transportation of notes from the device 38 to the case 44, the respective numbers memorized in the area 93 are reset to zero.

The operations for refilling a particular case (44A, 44B or 44C) are repeated until the maximum storage sensor 56 (A, B or C) senses the height of the notes reaching the predetermined maximum level (step 514, 522 or 530). Then the flag corresponding to the case refilled with notes is reset, and subsequent notes corresponding to the reset flag are transported to the device 38D.

Thus, as the cases in which notes have decreased below predetermined minimum levels are filled with the corresponding notes, all of the flags set in the storage area 99 are reset and the roller 46D is stopped (step 504). If the case 44D becomes empty and the case corresponding to a set flag cannot be refilled with notes to the predetermined maximum level, the circuit 88 generates a signal to instruct the clerk to replace the case 44D with a case containing an adequate amount of notes.

The above embodiment of the present invention may be modified as follows:

(a) In the refilling mode illustrated in FIG. 13, the flag for instructing the system to refill the corresponding case with notes may be set in response to an empty signal generated from the empty sensor 58A, 58B or 58C, not from the sensor 57A, 57B or 57C.

(b) The storage areas of the unit 89 further include storage areas for storing a system setting flag which is set on completion of the setting mode operations and a system resetting flag which is set on completion of the resetting mode operations so that the refilling operations may be performed during the time when the system setting flag remains set and the system resetting flag remains reset.

(c) Each of the temporary storage devices 38A to 38D may be constructed in such a manner that the same devices may drop the temporarily stored notes into the associated money case continuously or on an intermittent basis. With such an arrangement, the feeding of notes from the stock money case 44 to the individual money cases and from the latter cases to the former case need not be suspended.

Figure 9:
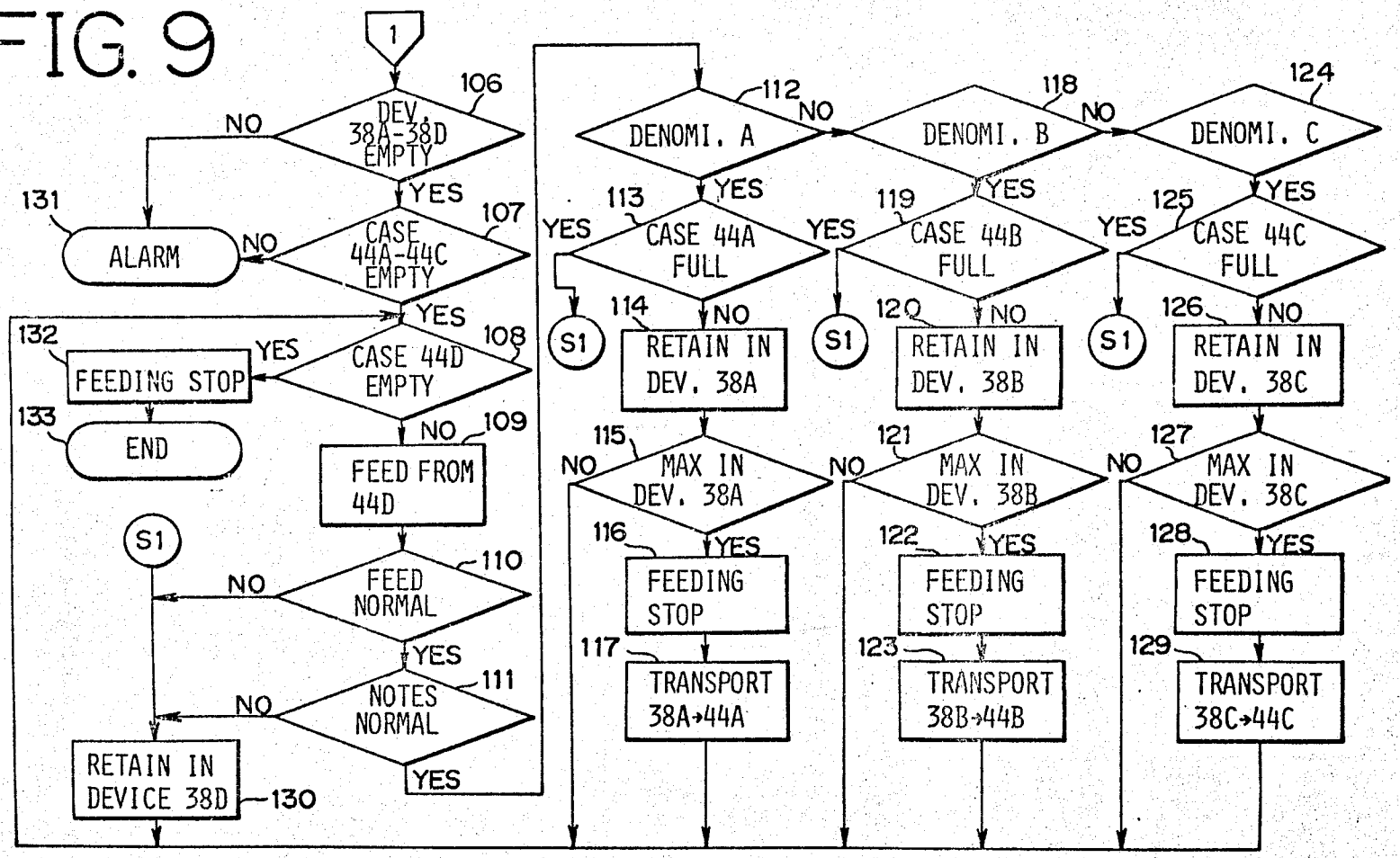
FIG. 9 is a flow chart illustrating the operation of t system in a setting mode shown in FIG. 8.

(d) In the setting mode illustrated in FIG. 9, the sequence may be modified so that a YES response to the inquiry at step 113, 119 or 125 is generated when the number of notes stored in the case 44A, 44B or 44C has reached a predetermined number memorized in the unit 89.

(e) The respective money cases 44A, 44B and 44C may be removably mounted in the system.

(f) The maximum or minimum storage in each of the cases 44 may be detected by comparing the number of notes stored in the particular case with a predetermined maximum or minimum number memorized in a data storage unit. Such a data storage unit includes a count area for counting the notes for storage in the particular case as positive counts and the number of notes for feeding therefrom as negative counts.

(g) The system may include a separately disposed collection box for collecting any particular notes which are genuine but cannot be used as normal notes for dispensing to customers. Such particular notes may be inky notes, dirty notes, partially broken notes and so forth.

(h) A well known spiral wings wheel may be employed in each of the temporary storage devices 38.

(i) The system may further include a timer for setting the time for initiating the setting operations illustrated in FIG. 9 and for setting the time for initiating the resetting operations illustrated in FIG. 10 in accordance with a predetermined time schedule of a bank.

(j) The sequence for refilling operations may be such that the flow chart for deposit operations illustrated in FIG. 11 includes a refilling routine where the notes for refilling the respective cases 44 may be supplied through the note inlet 12 and receiving portion 14 into the particular cases by means of the mechanism shown in FIG. 2 for the refilling mode.

(k) With a simple modification of the sequence described hereinbefore, the case 44D may be utilized, after completion of the setting mode, as a supplemental money case for storing notes of a denomination over the capacity of the individual money case corresponding to said denomination.

(l) The system may include a mechanism for directly transporting the notes retained in the respective temporary storage devices 38 to the dispensing portion 37, whereby in the deposit mode the deposited notes retained in the devices 38 may be returned to customers (step 329).

(m) The system may be modified to include more than four cases to increase the number of denominations available to the system or to provide a larger storage capacity for one or more denominations.

Figure 14:
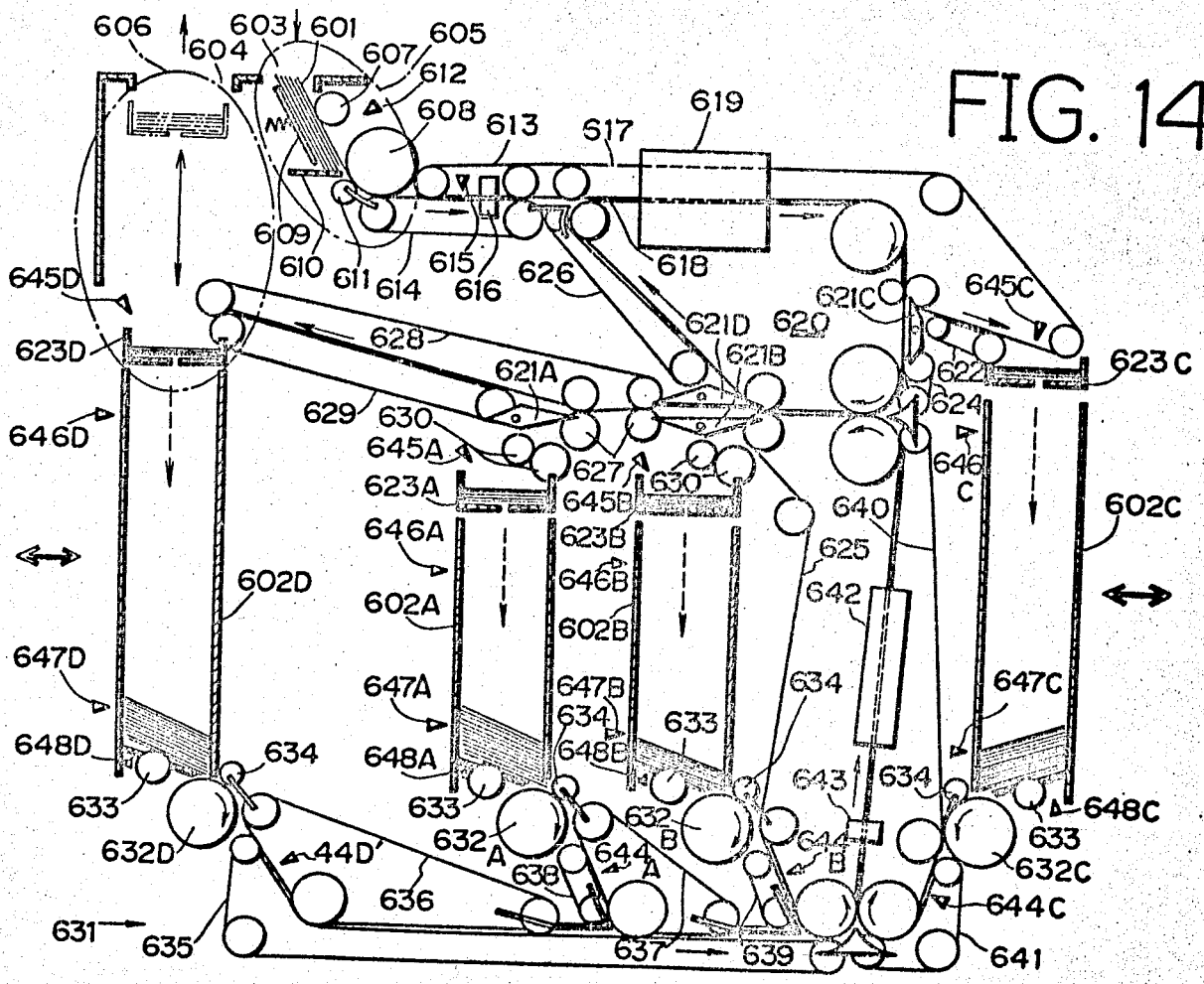

Referring to FIG. 14, there is shown a modified driving mechanism which may be employed in the system of FIG. 1 as another embodiment of the present invention. The mechanism includes a receiving portion 605 for receiving notes deposited into the system, a note checker 619 for sensing notes by denomination, a reviewer 642 for sensing notes by denomination, a money case 602A, a money case 602B, a removably mounted money case 602C, a removably mounted money case 602D, temporary storage devices 623A to 623D, a dispensing portion 606, and associated belt drive mechanisms.

In this embodiment, the system includes a selector for setting the system into a front mount mode or a back mount mode. The money case 602D is adapted to be mounted from the front of the system, and the money case 602C is adapted to be mounted from the back of the system.

In the front mount mode, the case 602D is used as a stock money case for containing notes of various denominations, and the cases 602A to 602C are adapted to store notes of the respective denominations A, B and C. Thus, in the setting mode (refer to FIG. 9), the notes contained in the case 602D are distributed to the respective cases 602A, 602B and 602C by a swingable plate 621A, a swingable plate 621B and a swingable plate 621D. The notes to the case 602C are transported from the case 602D by means of belts 635, 636, 625, 618 and 617 and the plate 621D. The system in a deposit mode distributes the deposited notes received in the portion 605 into the respective cases 602A to 602C or 602D by means of a swingable plate 621C, and plates 621A, 621B and 621D. The system in a withdrawal mode transports the notes stored in the cases 602A to 602C into the device 623D, and the device 623D is lifted up to a position where the noted retained in the devices 623D are dispensed to customers. The system in a resetting mode transports all of the notes stored in the respective cases 602A to 602C into the case 602D through the device 623D.

In the back mount mode, the case 602C contains notes of various denominations and is mounted into the system from the front. Then, the system in the setting mode distributes the notes from the case 602C to the respective cases 602A for denomination A, 602B for denomination B and 602D for denomination C. Other operations for deposit, withdrawal, resetting and filling modes are performed by the operation of swingable levers 621A to 621D.

If the deposited notes are found to be abnormal by the checker 619, they are transported to the dispensing portion 606. Alternatively, however, the notes may be returned to the checker 619 via belts 618, 625 and 626 and plate 621D a predetermined times for rechecks by the checker 619. And, after such repeated checking operations, the notes are judged to be distributable to the portion 606 or a particular case 602A, 602B, 602C or 602D.

It should be understood from the foregoing description that the money receiving and dispensing system may be used as a money processing apparatus which handles the monies deposited by a clerk, not customers, as an intraoffice apparatus for clerks. Moreover, the system may include a coin processing apparatus as an application of the system.

It should be understood that the above description is merely illustrative of the present invention and that many changes and modifications may be made by those skilled in the art without departing from the scope of the appended claims.

What is claimed is:

1. A money receiving and dispensing system, comprising:

a plurality of money cases for storing monies of several denominations, respectively;

a stock money cartridge removably mounted in the system for collectively storing monies available in the system;

a plurality of entering means each for entering moni into the corresponding one of said money cases ar stock money cartridge;

a plurality of feeding means for respectively feeding tl monies stored in said money cases and stock mone cartridge;

a money receiving means for receiving the money d posited into the system to store the received money i one of said money cases and stock money cartridg a money dispensing means for dispensing the money fe by one of said feeding means;

detecting and generating means for generating a mone supply signal when the quantity of monies in any c said money cases has decreased to a certain level; an means, in response to the generation of said mone supply signal, for feeding the monies stored in sai stock money cartridge, distributing the correspond ing ones of the fed monies into the particular mone case and returning into said stock money cartridg any monies of denominations other than the denomi nation corresponding to said particular money case.

2. A money receiving and dispensing system, com prising:

a plurality of money cases for storing monies of severa denominations, respectively;

a stock money cartridge removably mounted in the system for collectively storing monies available in the system;

a plurality of entering means each for entering monies into the corresponding one of said money cases and stock money cartridge;

a plurality of feeding means for respectively feeding the monies stored in said money cases and stock money cartridge;

a money receiving means for receiving the money deposited into the system to store the received money in one of said money cases and stock money cartridge;

a money dispensing means for dispensing the money fed by one of said feeding means;

detecting and generating means for generating a money maximum signal when the quantity of monies in any of said money cases has increased to a predetermined level; and means, in response to the generation of said money maximum signal, for preventing any more corresponding money from entering into said particular money case and distributing said prevented corresponding money into said stock money cartridge.

3. A money receiving and dispensing system, comprising:

a plurality of money cases for storing monies of several denominations, respectively;

a stock money cartridge removably mounted in the system for collectively storing monies available in the system;

a plurality of entering means each for entering monies into the corresponding one of said money cases and stock money cartridge;

a plurality of feeding means for respectively feeding the monies stored in said money cases and stock money cartridge;

a money receiving means for receiving the money deposited into the system to store the received money in one of said money cases and stock money cartridge;

a money dispensing means for dispensing the money fed by one of said feeding means; and means for detecting any abnormal feeding of monies from said money cases and means, on detection of said abnormal feeding, for returning the monies involved into the original corresponding money case.

4. A money receiving and dispensing system comprising:

a plurality of money cases for storing monies of several denominations, respectively;

a stock money cartridge removably mounted in the system for collectively storing monies available in the system, said stock money cartridge consisting of a pair of cases, one of said cases being removably mounted in the system from the front thereof, the other case being removably mounted in the system from the back thereof, and one of said pair of cases being optionally used as a money case for storing monies of a given denomination;

a plurality of entering means each for entering monies into the corresponding one of said money cases and stock money cartridge;

a plurality of feeding means for respectively feeding the monies stored in said money cases and stock money cartridge;

a money receiving means for receiving the money deposited into the system to store the received money in one of said money cases and said stock money cartridge; and a money dispensing means for dispensing the money fed by one of said feeding means.

5. A money dispensing and receiving system, comprising:

money receiving means for receiving monies deposited into the system;

money dispensing means for dispensing monies from the system;

identifying means for identifying the denominations of items of money fed thereto from said money receiving means;

a plurality of money cases adapted to deliver items of money to said money dispensing means;

a stock money cartridge suitable for collectively storing monies of all denominations available to the system and mounted in such a way as to be removable from the system; and a plurality of entering means each for entering monies into the corresponding said money cases in accordance with the denominations as identified by said identifying means;

a plurality of feeding means for respectively feeding the monies stored in said money cases and said stock money cartridge;

a setting switch; and a money distributing means, responsive to the operation of said setting switch, for actuating the feeding means of said stock money cartridge to feed the monies stored in said stock money cartridge and distributing the fed monies into said money cases in accordance with their denominations.

6. A system according to claim 5 further comprising:

a resetting switch; and a money collecting means, responsive to the operation of said resetting switch, for actuating the feeding means of said money cases to feed the monies stored therein and entering all of the fed monies into said stock money cartridge.

* * * * *